US009821188B2

(12) United States Patent
Dwork et al.

(10) Patent No.: US 9,821,188 B2
(45) Date of Patent: Nov. 21, 2017

(54) EXERCISE DEVICE FOR SUSPENDED BODY WEIGHT TRAINING

(71) Applicants: Matthew Dwork, Frisco, TX (US); Josh Dwork, Santa Rosa, CA (US)

(72) Inventors: Matthew Dwork, Frisco, TX (US); Josh Dwork, Santa Rosa, CA (US)

(73) Assignee: Stripe Fitness LLC, Fort Worth, TX (US)

( * ) Notice: Subject to any disclaimer, the term of this patent is extended or adjusted under 35 U.S.C. 154(b) by 242 days.

(21) Appl. No.: 14/819,567

(22) Filed: Aug. 6, 2015

(65) Prior Publication Data

US 2016/0045778 A1 Feb. 18, 2016

Related U.S. Application Data

(60) Provisional application No. 62/070,175, filed on Aug. 18, 2014.

(51) Int. Cl.

| | |
|---|---|
| ***A63B 21/068*** | (2006.01) |
| ***A63B 21/16*** | (2006.01) |
| ***A63B 21/00*** | (2006.01) |
| ***A63B 7/02*** | (2006.01) |

(Continued)

(52) U.S. Cl.

CPC ..... *A63B 21/16* (2013.01); *A63B 7/02* (2013.01); *A63B 21/00069* (2013.01); *A63B 21/068* (2013.01); *A63B 21/154* (2013.01); *A63B 21/4009* (2015.10); *A63B 21/4011* (2015.10); *A63B 21/4015* (2015.10); *A63B 21/4035* (2015.10); *A63B 21/4043* (2015.10); *A63B 23/1227* (2013.01); *A63B 23/1236* (2013.01);

(Continued)

(58) Field of Classification Search

CPC ..... A63B 21/16; A63B 21/00069; A63B 7/02; A63B 21/4015; A63B 23/1227; A63B 23/1236; A63B 21/4043; A63B 21/4035; A63B 21/4011; A63B 21/4009; A63B 21/154; A63B 21/06–21/068; A63B 21/00185; A63B 23/03533; A63B 23/1272

USPC ..... 482/23, 38–40, 43, 92–96, 98–99

See application file for complete search history.

(56) References Cited

U.S. PATENT DOCUMENTS

| | | | | |
|---|---|---|---|---|
| 864,188 | A * | 8/1907 | Patterson | A63B 21/068 482/143 |
| 1,374,697 | A * | 4/1921 | Werndli | A63B 21/154 482/95 |

(Continued)

*Primary Examiner* — Steve R Crow
*Assistant Examiner* — Garrett Atkinson
(74) *Attorney, Agent, or Firm* — Ward Law Office LLC; Jacob M. Ward

(57) ABSTRACT

A pulley system of an exercise device for suspended weight training includes a first block with a first pulley, a second pulley, and a first attachment point. A second block is removably coupled to a weight and includes a third pulley and a second attachment point. A grip is configured to be held by a user while exercising and has a third attachment point. A line having a first line end is fixedly coupled to the grip and a second line end fixedly is coupled to a connection element. The connection element is configured to be selectively coupled to each of the first attachment point, the second attachment point, and the third attachment point, permits a user to reduce an effective amount of the weight lifted by the user with movement of the grip to a pre-selected fraction of the weight.

7 Claims, 9 Drawing Sheets

(51) Int. Cl.
*A63B 23/12* (2006.01)
*A63B 23/035* (2006.01)

(52) U.S. Cl.
CPC ... *A63B 21/00185* (2013.01); *A63B 23/03533* (2013.01); *A63B 23/1272* (2013.01)

(56) References Cited

U.S. PATENT DOCUMENTS 2,183,265 A * 12/1939 Maloney ..... A61G 7/065 248/322
2,716,027 A * 8/1955 Gehri ..... A63B 21/023 482/131
3,118,441 A * 1/1964 Prosser ..... A61H 1/0218 482/122
3,937,461 A * 2/1976 Lew ..... A63B 7/02 182/6
4,052,070 A * 10/1977 Lew ..... A63B 7/00 482/96
4,079,933 A * 3/1978 Everroad ..... A63B 21/0004 482/131
4,109,907 A * 8/1978 Zito ..... A63B 21/06 482/904
4,125,257 A * 11/1978 Lew ..... A63B 7/00 24/129 B
4,431,184 A * 2/1984 Lew ..... A63B 7/00 482/102
4,674,485 A * 6/1987 Swanson ..... A61H 1/0218 602/33
4,843,687 A 7/1989 Kroepelin, Jr.
5,048,825 A * 9/1991 Kelly ..... A63B 21/154 482/904
5,129,647 A * 7/1992 Castellanos ..... A63B 21/055 482/124
5,176,602 A * 1/1993 Roberts ..... A63B 7/02 482/129
5,178,590 A * 1/1993 Stephens ..... A63B 7/02 482/23
5,360,384 A * 11/1994 Toensing ..... A63B 69/0064 482/23
5,403,253 A * 4/1995 Gaylord ..... A63B 21/068 482/140
5,713,821 A * 2/1998 Nissen ..... A63B 23/04 482/114
5,820,534 A 10/1998 Vadher
5,885,190 A * 3/1999 Reiter ..... A63B 7/00 482/129
6,113,564 A * 9/2000 McGuire ..... A61H 1/0229 482/131
6,267,711 B1 * 7/2001 Hinds ..... A63B 1/00 482/121
6,554,747 B1 * 4/2003 Rempe ..... A63B 21/04 482/38
6,705,974 B1 * 3/2004 Tardif ..... A63B 21/068 482/148
7,104,935 B2 * 9/2006 Matsuoka ..... A63B 21/0004 482/121
7,255,666 B2 * 8/2007 Cardenas ..... A61H 1/0229 482/143
8,152,704 B2 * 4/2012 Brice ..... A63B 21/00 482/129
8,661,720 B2 3/2014 Miller
8,807,051 B2 8/2014 Johnson
8,849,444 B2 9/2014 George
8,955,197 B2 2/2015 Bailey
8,992,395 B2 3/2015 Orakwusi
2007/0278464 A1 * 12/2007 Constant ..... B60P 1/5471 254/1
2010/0292056 A1 * 11/2010 Birch ..... A63B 21/00185 482/129
2011/0166003 A1 * 7/2011 Brice ..... A63B 21/00 482/131
2012/0277074 A1 * 11/2012 Zeldakov ..... A63B 21/154 482/126
2013/0184124 A1 7/2013 Reed
2013/0288861 A1 * 10/2013 Cole ..... A63B 21/0618 482/102
2014/0005015 A1 * 1/2014 Hester ..... A63B 21/154 482/131

* cited by examiner

EXERCISE DEVICE FOR SUSPENDED BODY WEIGHT TRAINING

CROSS-REFERENCE TO RELATED APPLICATIONS

This application claims priority to U.S. Provisional Patent Application Ser. No. 62/070,175 filed on Aug. 18, 2014. The entire disclosure of the above application is hereby incorporated herein by reference.

FIELD

The present invention relates to exercise or sports equipment, and in particular, to an exercise equipment system mountable to a fixed point utilizing a pulley system, handles, and a self-adjustable body harness to leverage body weight resistance exercise movements.

BACKGROUND

A wide array of exercise equipment intended for home use is prevalent on the market today. Certain types of home exercise equipment are targeted on strength training, and may be specifically targeted at particular muscle movements (such as pull/chin up bars), or may be targeted to whole body training programs and include multiple pieces of equipment. Home use and privacy of exercise have become greatly popularized over the past several years, particularly due to increasing gym membership fees and increasing complexity of individual work and home schedules.

In general, equipment available for home exercise equipment require the user of the equipment to be able to use them as marketed. However, large segments of the population simply do not have the physical strength or ability start exercising at levels required by such home exercise equipment. To compensate, some equipment allows for resistance training at varying levels of resistance, but require complicated equipment interconnections or require movement of objects of varying mass (i.e. "weights") to adjust the resistance levels felt by the user. Such adjustable equipment may be complex to use, and is often expensive and complicated to purchase and set up for use.

It is therefore desirable provide a home exercise system and method that is relatively inexpensive and is simple to set up and use, that is also able to accommodate users of all ages, strength limitations, range of motion issues, while providing a unique user experience.

SUMMARY

In concordance with the instant disclosure, a home exercise system and method that is relatively inexpensive and is simple to set up and use, that is also able to accommodate users of all ages, weights, and strength levels while providing a high range of motion and a unique user experience, has surprisingly been discovered.

A pulley system of an exercise device for suspended weight training is provided, including a first block configured to removably connect to a raised position above a floor surface. The first block has a first pulley, a second pulley, and a first attachment point. A second block is removably coupled to a weight and includes a third pulley and a second attachment point. A grip is configured to be held by a user while exercising. The grip has a third attachment point. A line having a first line end is fixedly coupled to the grip and a second line end fixedly is coupled to a connection element.

The connection element is configured to be selectively coupled to each of the first attachment point, the second attachment point, and the third attachment point. The line extends from the grip around the first pulley, around the third pulley, and around the second pulley, wherein the selective coupling of the connection element to each of the first attachment point, the second attachment point, and the third attachment point permits a user to reduce an effective amount of the weight lifted by the user with movement of the grip to a pre-selected fraction of the weight.

In one embodiment, the weight is a body of the user, where resistance to the body weight of the user is selectively determined based on the selective coupling of the connection element to, only on at a time, each of the first attachment point, the second attachment point, and the third attachment point.

In another embodiment, the exercise device includes a harness for a body of the user, where the harness is configured to removably couple to the second block.

A harness of an exercise device for suspended weight training is also provided. The harness includes a user-adjustable suspension belt for securing around a waist of a body of a user that is configured to couple to a pulley system of the exercise device. A set of support straps is removably coupled to the suspension belt for distributing weight to a lower extremity of the user, wherein the support straps include both knee support straps and foot support stirrups.

In one embodiment, the harness includes a pair of suspension mounts disposed on opposing sides of the suspension belt, the mounts configured to couple the suspension belt to the pulley system of the exercise device.

In another embodiment, the foot support stirrups and the knee support straps are connected to the suspension belt with leg stirrups. The foot support stirrups are configured to support an entirety of the body of the user while the user's knee are unbent and the user is in an upright position, and the knee support straps are configured to support an entirety of the body of the user upon a bending of the user's knees while the user is in an upright position.

An exercise device for suspended weight training is also provided. The exercise device includes a pulley system having a first block configured to removably connect to a raised position above a floor surface. The first block has a first pulley, a second pulley, and a first attachment point. The exercise device further includes a second block having a third pulley and a second attachment point. A grip having a third attachment point is configured to be held by a user while exercising. The exercise device further includes a line having a first line end fixedly coupled to the grip and a second line end fixedly coupled to a connection element. The connection element is configured to be selectively coupled to each of the first attachment point, the second attachment point, and the third attachment point. The line extends from the grip around the first pulley, around the third pulley, and around the second pulley. A harness is removably coupled to the second block of the pulley system, wherein the harness has a user-adjustable suspension belt for securing around a waist of a body of the user. A set of support straps is removably coupled to the suspension belt for distributing weight to a lower extremity of the user, wherein the support straps include both knee support straps and foot support stirrups. The selective coupling of the connection element to each of the first attachment point, the second attachment point, and the third attachment point permits the user to reduce an effective amount of the weight lifted by the user with movement of the grip to a pre-selected fraction of the weight, and wherein the weight includes a body of the user in the harness.

BRIEF DESCRIPTION OF THE DRAWINGS

The above, as well as other advantages of the present invention will become readily apparent to those skilled in the art from the following detailed description of the preferred embodiments when considered in light of the accompanying drawings, in which.

DETAILED DESCRIPTION

The following detailed description and appended drawings describe and illustrate various exemplary embodiments of the disclosure. The description and drawings serve to enable one skilled in the art to make and use the disclosure, and are not intended to limit the scope of the disclosure in any manner. In respect of the methods disclosed, the steps presented are exemplary in nature, and thus, the order of the steps is not necessary or critical, unless otherwise disclosed.

Figure 1:
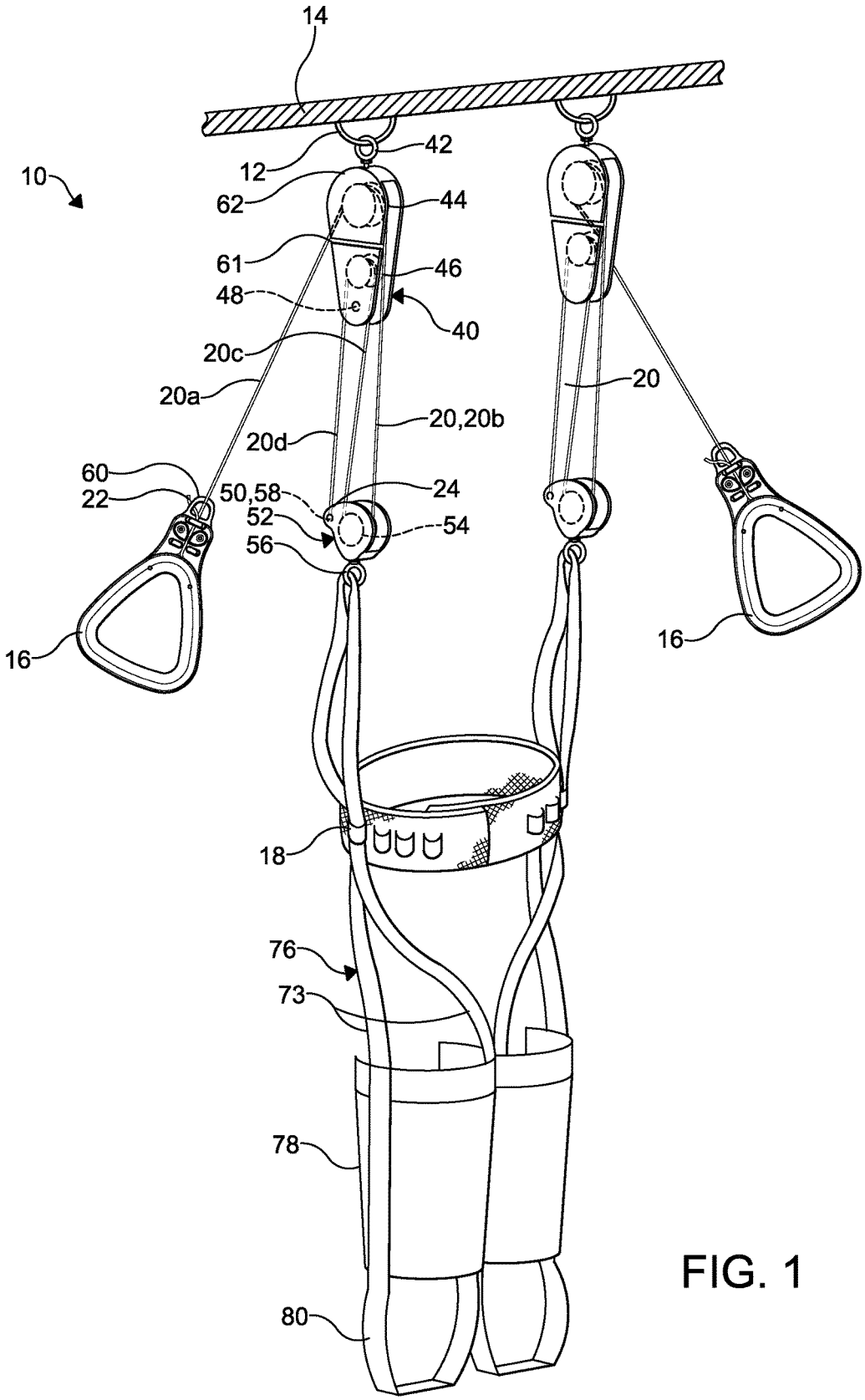
FIG. 1 is a perspective view of an embodiment of an exercise device for suspended weight training according to an embodiment of the disclosure.
Figure 2:
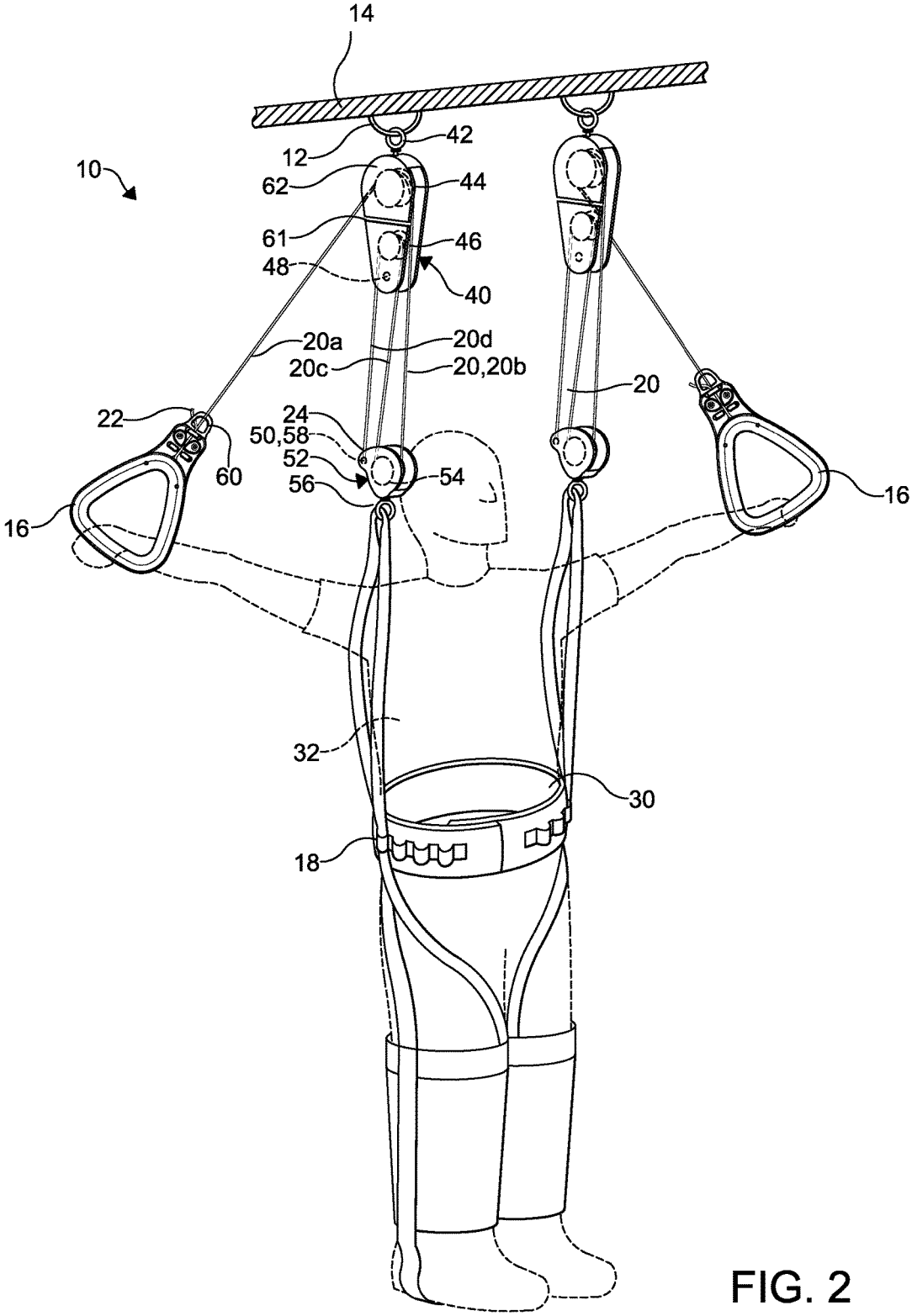
FIG. 2 is a perspective view of the exercise device shown in FIG. 1, the exercise device being employed by a user standing substantially upright in a harness.
Figure 3:
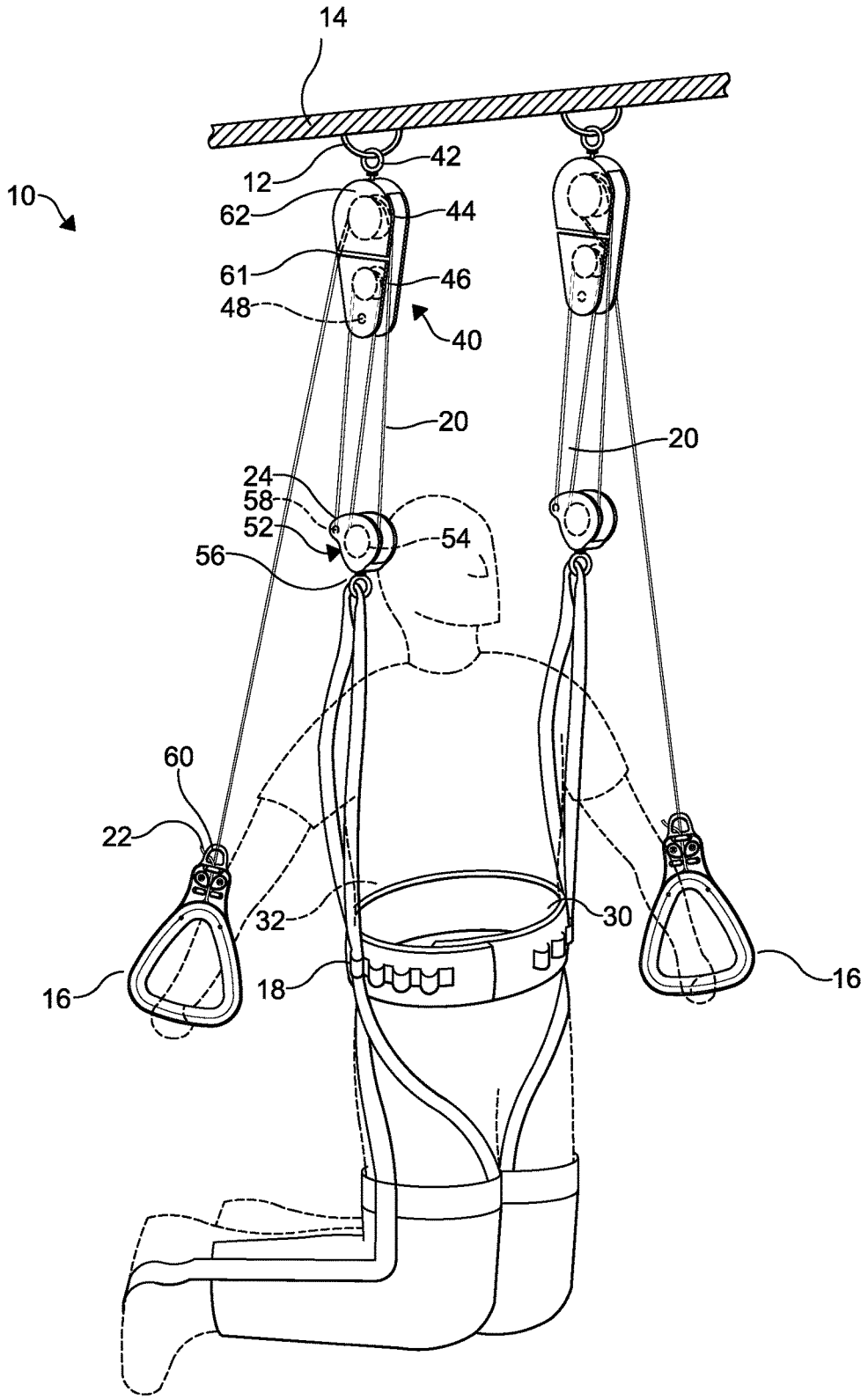
FIG. 3 is a perspective view of the exercise device shown in FIGS. 1-2, the exercise device being employed by the user having knees bent in the harness.

An exercise device 10 for suspended weight training is shown with reference to FIGS. 1-3. An optional ceiling mount 12 is shown mounted in a ceiling 14 in combination with the exercise device 10. It should be understood that the exercise device 10 may be utilized with or without the ceiling mount 12, and is not limited to being mounted to the ceiling 14. As a non-limiting example, the exercise device 10 may be mounted in a door frame using an optional door mount, or may be mounted to any vertical or horizontal surface above the floor.

The exercise device 10 includes two grips 16, each individually coupled to a single harness 18 with a line 20. While the exercise device 10 of FIGS. 1-3 is shown having two grips 16, each grip coupled to the harness 18 with two separate lines 20, only one of each feature will be described herein below. It is further understood that the two separate lines 20 may, in fact, be combined into a single line 20 or can be formed from multiple lines 20, as desired, in order to further enhance the adjustability and adaptability of the present invention.

The harness 18 is intended to be removably coupled to a weight. As best shown in FIGS. 2-3, the harness 18 may be configured to fit around a waist area 30 of a user 32 of the exercise device 10, where the body of the user 32 provides the weight. However, the harness 18 may also be configured to fit around free weights or specially designed weights. Although the harness 18 shown in FIGS. 1-3 involves a belt and stirrup assembly, as described further herein with respect to FIG. 7, it should be understood that other types of the harness 18 are also contemplated. In certain embodiments, the harness 18 may include only a belt configured to couple to the exercise device 10. Further embodiments of the harness 18 according to the present disclosure are also discussed below with reference to FIGS. 8A-8B, for example.

With renewed reference to FIGS. 1-3, the grip 16 is coupled to a first end 22 of the line 20. It is understood that the line may be formed from any suitable material sufficient to support a weight (not shown) coupled to the harness 18. As a non-limiting example, the line 20 may be formed from natural or synthetic rope, strap, wire, braided cable, or the like. The first end 22 of the line 20 may be removably or fixedly coupled to the grip 16, as desired.

Figure 5B:
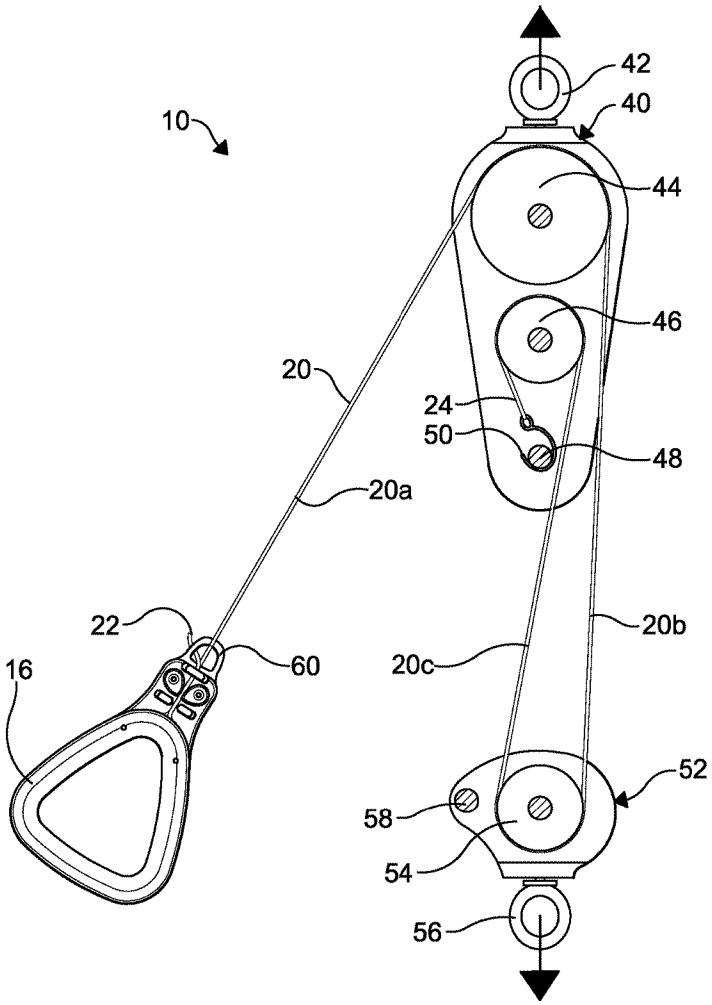
FIGS. 5A, 5B, and 5C are side elevational views of the exercise device according to various embodiments of the disclosure, each showing a selective coupling of a connection element at a different attachment point to reduce an effective amount of weight to a predetermined fraction of the weight, each of the blocks illustrated with a sidewall removed to show the underlying pulleys and the attachment points.
Figure 5A:
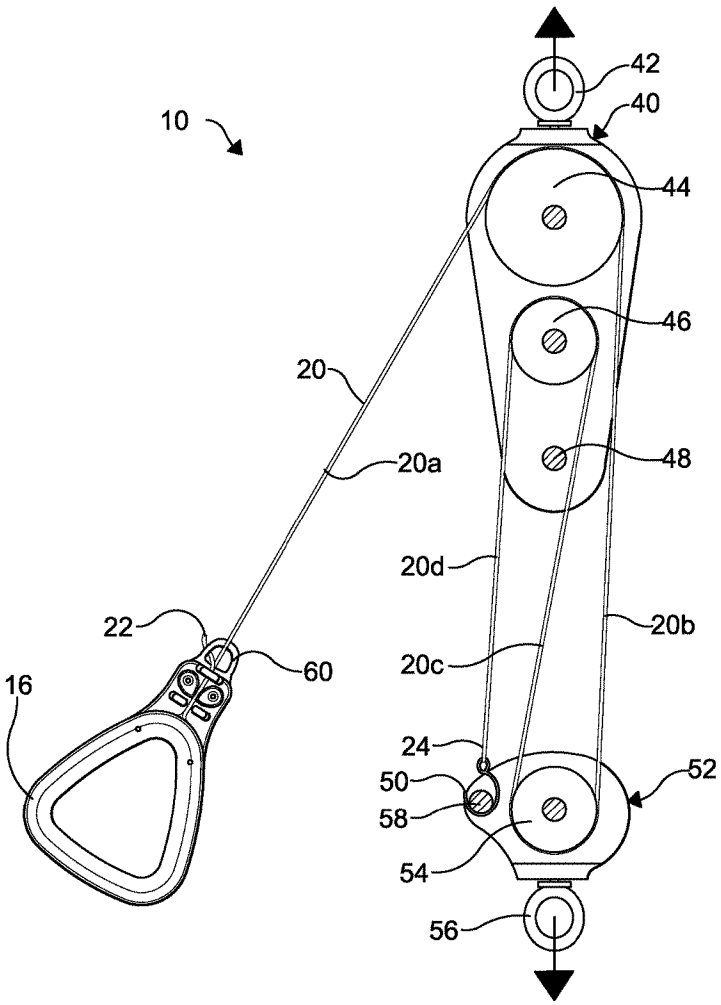
Figure 5C:
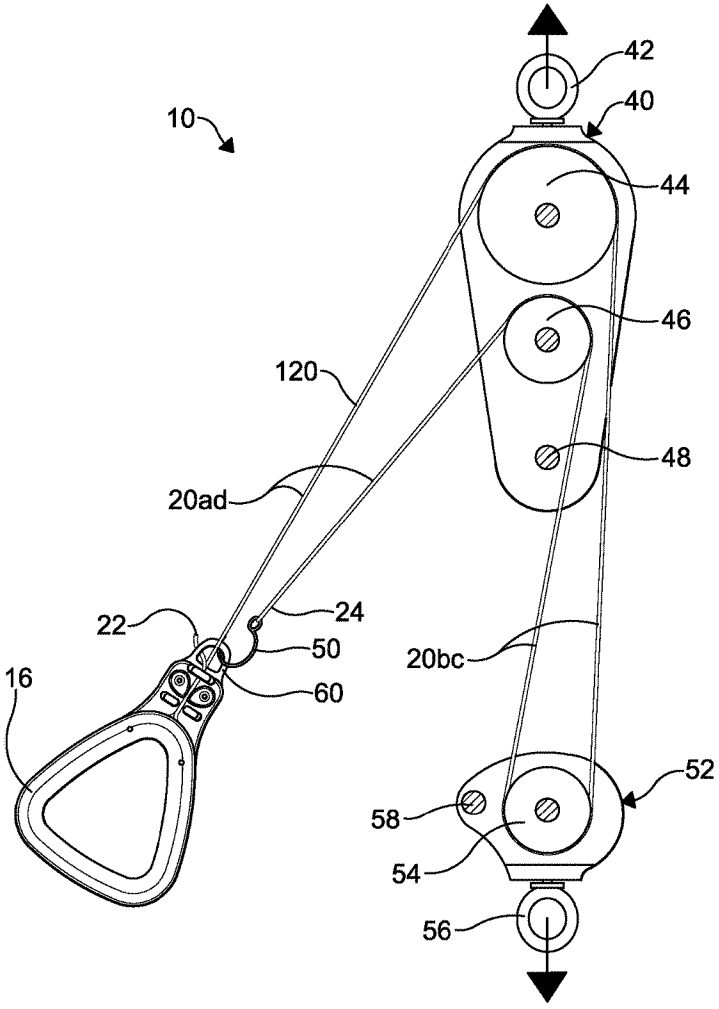

A second end 24 of the line 20 is removably coupled to one of a plurality of predetermined attachments points 48, 58, 60, so that movement of the grip 16 will result in movement of the harness 18 (and likewise the weight coupled to the harness 18) as described further herein with respect to FIGS. 5A-5C. Any suitable means for connecting the second end 24 of the line 20 with one of the attachment points 48, 58, 60 may be employed. As nonlimiting examples, the second end 24 of the line 20 may have a connection element 50 including one of a hook or a clip. One of ordinary skill in the art may select other suitable structure for connecting the second end 24 of the line 20 with one of the attachment points 48, 58, 60, as well as for the attachment points 48, 58, 60 themselves, as desired.

Figure 4B:
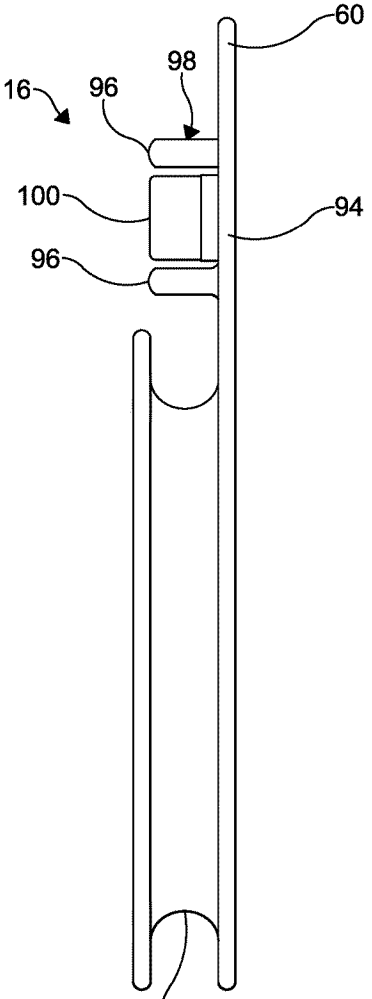
FIGS. 4A, 4B, and 4C are front elevational, side elevational, and front perspective views, respectively, of a grip of the exercise device shown in FIGS. 1-3.
Figure 4A:
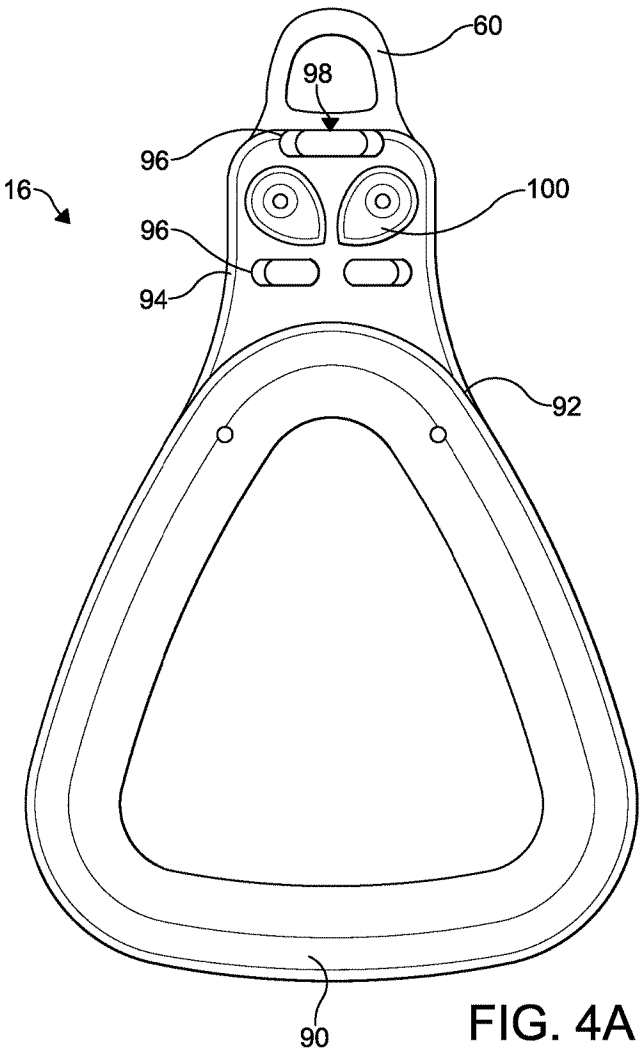
Figure 4C:
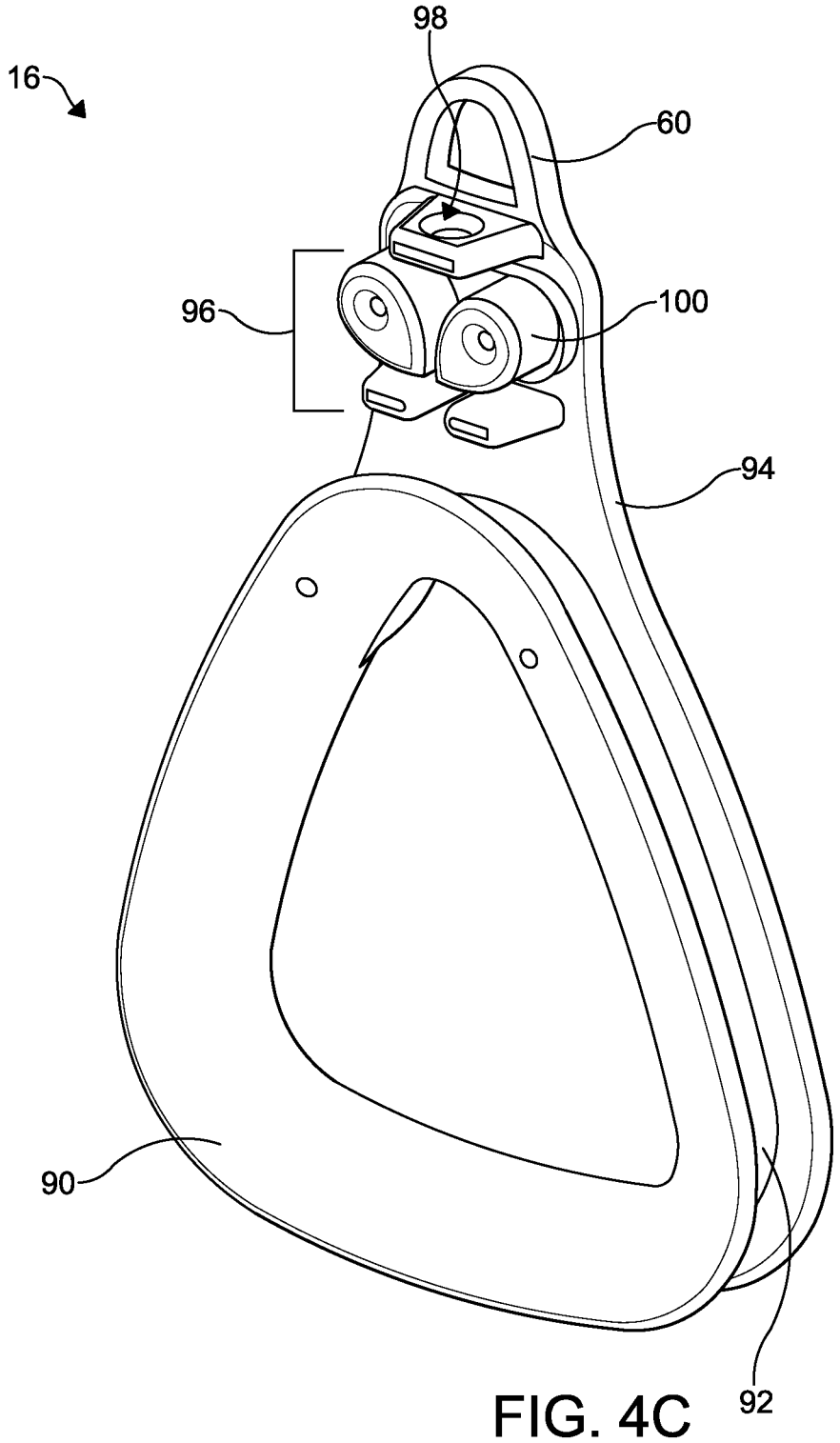

The grip 16 may be formed into any form or shape configured to be held by the user while exercising, in order to allow use of the exercise device 10. As a non-limiting example, and according to an embodiment of the invention, the grip 16 is shown in FIGS. 4A-4B having a generally triangular shape. The grip 16 includes an inner surface 90 configured to allow a user to easily grasp the grip 16. An outer circumference of the grip 16 includes an integrally formed groove 92 into which an excess length of the line 20 (not shown in FIGS. 4A-4B) may be accumulated. A flange 94 is formed adjacent one corner of the generally triangular grip 16 that includes one or more guides 96 for stabilizing and guiding the line 20 into the groove 92 to allow the excess length of the line 20 to be spooled around the outer circumference of the grip 16 and to be accumulated within the groove 92. The one or more guides 96 may further include an aperture 98 formed in the flange through which the first end 22 of the line 20 may be threaded before or after the one or more guides 96. The flange may optionally include a cam locking mechanism or cleats 100 configured to lock the line 20 in place and to prevent the line 20 from winding and unwinding inadvertently during exercise. The cleats 100 may be spring-loaded and biased toward each other, for example, and configured to pinch and securely hold the line 20 when a tension is placed on the line in a direction away from the grip 16, for example, when the user pulls on the grip 16.

It should be appreciated that the grip 16 is designed to allow a functional length of the line 20 to be readily adjusted by the user. An excess length of the line 20 may be stored within the groove 92, while the one or more guides 96, including the aperture 98, cooperate with the line 20 ensure proper orientation of the line 20 and to further ensure that the line 20 is neatly and easily adjusted to an appropriate functional length. Once an appropriate functional length of the line 20 extends from the grip 16, the line 20 adjacent the flange 94 is secured by the cleats 100 to prevent further winding and unwinding.

Returning to FIGS. 1-3, the exercise device may include a first block 40 configured to be removably connected to a raised position above a floor surface, such as to the ceiling mount 12. As used herein, the term "block" is defined to mean a housing or unit supporting one or more pulleys. As a non-limiting example, the first block 40 may include a connector 42 configured to allow the user to removably connect the first block 40 to a wall, a door, a door frame mount, a ceiling, or the like, using a bolt, a hook, a mount, or the like. For example, it is understood that the connector 42 may be provided as a swivel loop or the like, in order to allow the first block 40 to rotate to facilitate the proper orientation of the line 20, and further to prevent the line 20 from tangling or to urge the line to automatically untangle. As used herein, the term "swivel loop" includes an eyelet or clip connected by a rod on bearings disposed in the block, which permits a free-spinning, 360 degree rotation of the eyelet or clip. Other suitable types of the connector 42 may also be employed within the scope of the disclosure.

The first block 40 includes a first pulley 44, and optionally may include a second pulley 46. It is understood that the first block 40 may substantially fully enclose the first pulley 44 and the second pulley 46 in certain embodiments. It is further understood that the first pulley 44 and the second pulley 46 may not be fully enclosed, and may be visible and accessible by the user, as desired.

As a non-limiting example, shown in FIGS. 1-3, a slot 61 may be formed in a side wall 62 of the first block 40 to provide access to the second pulley 46, thereby allowing a user to thread the line 20 as required through the first pulley 44 and the second pulley 46, as further described herein below. In such examples, the sidewall 62 may also be provided to a latch or a door (not shown) to at least partially enclose the first pulley 44 and the second pulley 46 after the line 20 is arranged in the first block 40.

A first attachment point 48 may be formed at any location on the body of the first block 40. The first attachment point 48 is configured to selectively receive a connection element 50 disposed at the second end 24 of the line 20. The connection element 50 is described in more detail herein below, with a particular embodiment further shown in FIGS. 5A-5C.

In one embodiment, the second pulley 46 is disposed on the first block 40 between the first pulley 44 and the first attachment point 48, in order to prevent the second end 24 of the line 20 from crossing with any other portion of the line 20 when the second end 24 is connected to the first attachment point 48. This militates against any interference, friction, wear, or tangles of the line 20. However, it is understood that the second pulley 46 may be disposed anywhere on the first block 40 as desired, so long as the line 20 moves along a defined serpentine path, and does not spiral or have portions of the line 20 contacting other portions of the line 20. Accordingly, the second pulley 46 may be located adjacent the first pulley 44, or even above the first pulley 44, so long as the line 20 defines a serpentine path.

The exercise device 10 of FIGS. 1-3 includes a second block 52 configured to removably couple to the weight, for example, the body of the user via the harness 18 as shown in FIGS. 2-3. The second block 52 may include a connector 56 configured to allow the user to removably connect the second block 52 to the weight including to the harness 18. As non-limiting examples, the connector 56 may include a bolt, a hook, or the like. In certain embodiments the connector 56 may include a swivel loop or the like, in order to allow the second block 52 to rotate and facilitate the proper orientation of the line 20. This further militates against the line 20 tangling, or urges the line 20 to automatically untangle.

The second block 52 also includes a third pulley 54 and a second attachment point 58. The second attachment point 58 may be formed at any location on the body of the second block 52, and is configured to selectively receive the connection element 50, as described in more detail below, for example, as shown in FIG. 5A-5C.

The line 20 extends from the first end 22 coupled to the grip 16, around the first pulley 44, the third pulley 54, and the second pulley 46 to the second end 24. The second end is removably coupled to one of the attachment points 48, 58, 60. The first pulley 44 is mounted at a raised position above the floor 34. In combination with the length of the line 20, the harness 18, and the grip 16, the first pulley 44 serves to support the weight held by the harness 18 such as, for example, the body of the user 32 (shown in FIGS. 2 and 3). The user 32 is therefore able to perform many and varied exercises using either a separate weight or the weight of the user's body as resistance in the exercise. Additionally, because the user 32 is able to reach the floor 34, the user 32 may selectively support some of the weight held in the harness 18. In particular, the user 32 is able to utilize different feet planted positions as a beginner to allow for adjusted maximum load assistance during exercise. The user 32 may later elevate to unsupported mid-air positions as the user progresses to intermediate and advanced strength and stability levels. Thus, the user 32 has full control over body weight load, physical limitations and progression of strength exercised.

As shown in FIGS. 1-3, when the connection element 50 couples the line 20 to the second attachment point 58, the line 20 extends from the first end 22 of the line attached to the grip 16, around the first pulley 44 attached to the first block 40, around the third pulley 54 attached to the second block 52, around the second pulley 46 attached to the first block 40, and back to the second attachment point 58 attached to the second block 52. Since the second block 52 is attached to the weight by the connector 56, four line portions 20*a*, 20*b*, 20*c*, and 20*d* support any weight attached to the second block 52. Accordingly, the user 32 is able to reduce an effective amount of the weight lifted by the user 32 with movement of the grip 16 to one-fourth of the actual weight attached to the second block 52.

It should be appreciated that one or more blocks of pulleys may be used to further allow the user 32 to control the weight load being lifted. The ability of the user 32 to rapidly adjust an effective amount of the weight used in the exercise is further described with reference to FIGS. 5A-5C. In particular, the second end 28 of the line 20 may be selectively and removably attached to one of several predetermined attachment points 48, 58, 60 to reduce the effective amount of the weight lifted by the user 32.

In FIGS. 5A-5C, depictions of the exercise device 10 according to various configurations are shown. The exercise device 10 includes the at least one grip 16 coupled to the line 20. The grip 16 is substantially as described with reference to FIGS. 4A-4B. However, it is understood that the grip 16 may be formed as desired into any form or shape configured to be held by the user 32 while exercising to allow use of the exercise device 10. The grip 16 is coupled to a first end 22 of the line 20. The first end 22 of the line 20 may be removably or fixedly coupled to the grip 16. In particular, the grip 16 may be formed with a feature to allow an adjustment of a length of the line 20, as, for example, a groove or a take up spool formed integrally on the grip 16, or alternatively, the line 20 may feed through an aperture formed in the grip 16 to allow an adjustment of the length of the line 20.

The exercise device 10 further includes the first block 40 configured to be removably connected to a raised position above the floor surface (not shown). As a non-limiting example, the first block 40 may include the first connector 42 configured to allow the user 32 to removably connect the first block 40 to a wall, a door, a door frame mount, a ceiling, or the like, using a bolt, a hook, a mount, or the like. The first block 40 includes the first pulley 44, and optionally may include the second pulley 46.

The first attachment point 48 may be formed at any location on the body of the first block 40. The first attachment point 48 is configured to selectively receive the connection element 50 attached to the second end 24 of the line 20, as described in more detail below and as shown in FIG. 5B. For example, the first attachment point 48 may be in the form of a bar or rod disposed between a pair of sidewalls of the first block 40, which can selectively couple with the connection element 50 in the form of a clip or hook. In other examples, the first attachment point 48 is defined by a hole formed in the first block 40. The first attachment point 48 may be formed on the outside or the inside of the first block 40, as desired, as long as it permits a selective attachment of the first block 40 with the connection element 50. Other suitable structure for both the first block 40 and the connection element 50 may be selected by a skilled artisan, as desired.

In one embodiment, the second pulley 46 is disposed on the first block 40 between the first pulley 44 and the first attachment point 48, in order to prevent the line 20 from crossing or interfering with any portion of the line 20, thereby preventing any interference, friction, wear, or tangles.

The exercise device 10 includes the second block 52 configured to removably couple to the weight (not shown in FIGS. 5A-5C). As a non-limiting example, the second block 52 may include the second connector 56, which is configured to allow the user to removably connect the second block 52 to the weight, including to the harness 18 (for example, FIGS. 1-3 and 7-8B), using a bolt, a hook, or the like.

The second block 52 includes the third pulley 54 and the second attachment point 58. The second attachment point 58 may be formed at any location on the body of the second block 52, and is configured to selectively receive the connection element 50, as described in more detail below and as shown in FIG. 5A. For example, the second attachment point 58 may be in the form of a bar or rod disposed between a pair of sidewalls of the second block 52, which can selectively couple with the connection element 50 in the form of a clip or hook. In other examples, the second attachment point 58 is defined by a hole formed in the second block 52. The second attachment point 58 may be formed on the outside or the inside of the second block 52, as desired, as long as it permits a selective attachment of the second block 52 with the connection element 50. Other suitable structure for both the second block 52 and the connection element 50 may be selected by a skilled artisan, as desired.

In one embodiment, the second attachment point 58 of the second block 52 is disposed between the first attachment point 48 of the first block 40 and the third pulley 54 of the second block 52. The second connector 56 is disposed between the third pulley 54 of the second block 52 and the floor surface. This arrangement of the second block 52 prevents the line 20 from contacting any other portion of the line 20, thereby preventing any interference, friction, wear, or tangles.

Optionally, the grip 16 includes the third attachment point 60 configured to selectively receive the connection element 50, as shown in FIG. 5C. The third attachment point 60 may be in the form of flange having a hole formed therein, for example, and configured to couple with the connection element 50 in the form of a hook or clip. Other suitable structure for the third attachment point 60 and the connection element 50 may be selected by a skilled artisan, as desired.

In operation, the user is allowed to selectively attach the connection element 50, attached to the second end 24 of the line 20, to one of the first attachment point 48, the second attachment point 58, and the third attachment point 60.

In a first configuration shown in FIG. 5A, where the connection element 50 couples the line 20 to the second attachment point 58, the line 20 extends from the first end 22 of the line 20 attached to the grip 16 around the first pulley 44 attached to the first block 40, around the third pulley 54 attached to the second block 52, around the second pulley 46 attached to the first block 40, and back to the second attachment point 58 attached to the second block 52. Since the second block 52 is attached to the weight by the second connector 56, the four line portions 20*a*, 20*b*, 20*c*, and 20*d* support the weight attached to the second block 52. Accordingly, by choosing the first configuration shown in FIG. 5A, the user is able to reduce an effective amount of the weight lifted by the user with movement of the grip 16 to one-fourth of the actual weight attached to the second block 52.

In a second configuration shown in FIG. 5B, where the connection element 50 couples the line 20 to the first attachment point 48, the line 20 extends from the first end 22 of the line 20 attached to the grip 16 around the first pulley 44 attached to the first block 40, around the third pulley 54 attached to the second block 52, around the second pulley 46 attached to the first block 40, and to the first attachment point 48 attached to the first block 40. Since the first block 40 is attached to a raised position above a floor surface, three line portions 20*a*, 20*b*, and 20*c* support any weight attached to the second block 52. Accordingly, by choosing the second configuration shown in FIG. 5B, the user is able to reduce an effective amount of the weight lifted by the user with movement of the grip 16 to one-third of the actual weight attached to the second block 52.

In a third configuration shown in FIG. 5C, where the connection element 50 couples the line 20 to the third attachment point 60 on the grip 16, the line 20 extends from the first end 22 of the line 20 attached to the grip 16, around the first pulley 44 attached to the first block 40, around the third pulley 54 attached to the second block 52, around the second pulley 46 attached to the first block 40, and to the third attachment point 60 attached to the grip 16. While it appears that there are four line portions supporting the weight attached to the second block 52, there are two line sets 20*ad* and 20*bc* that share the load of any weight attached to the second block 52. Accordingly, by choosing the third configuration shown in FIG. 5C, the user is able to reduce an effective amount of the weight lifted by the user with movement of the grip 16 to one-half of the actual weight attached to the second block 52.

Importantly, in the various configurations shown in FIGS. 5A-5C, the line portions 20*a* through 20*d* are arranged in a serpentine path and never cross or contact any other of the line portions. This militates against any interference, friction, wear, or tangles between any of the line portions 20*a* through 20*d*.

It should be appreciated that the exercise system 10 of the present disclosure is highly adjustable, and is not necessarily limited to the configurations shown in FIGS. 5A-5C. As a non-limiting example, it is understood that the exercise system 10 may include more than three attachment points 48, 58, 60, and more than three pulleys 44, 46, 54, in order to provide additional options for the user to selectively reduce an effective amount of the weight lifted by the user with movement of the grip 16.

As further non-limiting examples, the grip 16 of the exercise system 10 may include an additional attachment point (not shown) to which the connection element 50 may be selectively attached, and the harness 18 attached to the weight may include additional pulleys (not shown) to improve the mechanical advantage of the user.

A length of the line 20 may also be adjusted by the user for use with the exercise system 10. Adjustability of the line 20 allows the user to perform exercises of different heights and in different planes of motion. For example, the user may lengthen the line 20 to perform less inclined pushups, or greater inclined pushups to increase and/or decrease exercise difficulty. Users varying in height and size may also adjust this rope length to accommodate their particular physiques.

It is understood that the connection element 50 may be configured in any way to selectively attach to the various attachment points 48, 58, 60. It is further understood that the various attachment points 48, 58, 60 may be configured in any way to interact with the connection element 50.

Figure 6:
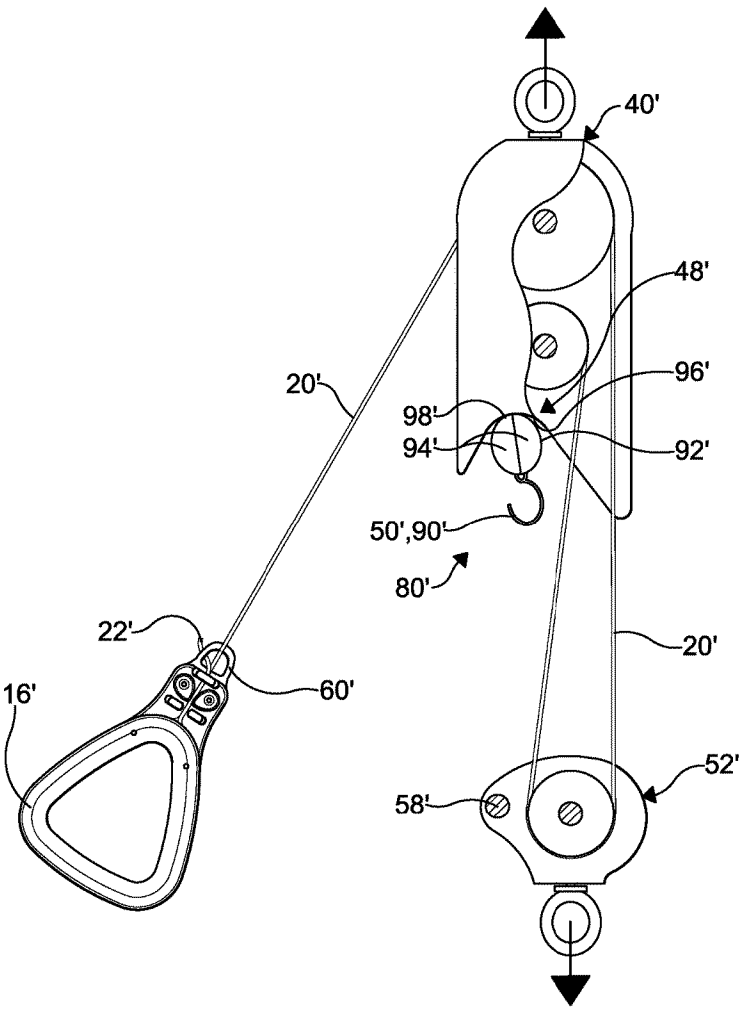
FIG. 6 is a side elevational view of the exercise device according to an alternative embodiment of the disclosure, showing an alternate configuration of the connection element as a three-dimensional piece seated in a recess of the block, and one of the blocks depicted with a sidewall partly removed to show the underlying pulleys.

One alternative connection element 50' is described with reference to FIG. 6. In FIG. 6, like or related structure to that shown in FIGS. 1-5C is identified with the same reference number and a prime symbol (') for purpose of clarity. The connection element 50' may include a clip 90' and a three dimensional element 92'. The second end 24' of the line 20' passes first through the three dimensional element 92' before being fixedly attached to the clip 90'. It is understood that the three-dimensional element 92' may have any common shape and size, and is shown in FIG. 6 as a substantially spheroid element. It is further understood that the three-dimensional element 92' may be formed as a single piece. However, the three-dimensional element 92' shown in FIG. 6 is formed as two separate half elements 94' fastened together such that the line 20' is sufficiently compressed between the half elements 94', in order to prevent movement of the three-dimensional element 92' axially along the line 20' even when a force is exerted against the three-dimensional element 92'.

In FIG. 6, the first block 40' has the first attachment point 48'. The first attachment point 48' includes a seating surface 96' that is sized to receive an outer contour 98' of the three-dimensional element 92'. The seating surface 96' may be arcuate, for example, and conform generally to the shape of the three-dimensional element 92'. The clip 90' is configured to attach to the second attachment point 58' and the third attachment point 60', in a manner similar to that described above with the connection element 50 in FIGS. 5A and 5C. However, the three-dimensional element 92' accounts for the situation where the first block 40' is mounted above the reach of the user 32. To avoid requiring a ladder or stool in order to attach the clip 90' to the first attachment point 48', the three-dimensional element 92' instead is seated in and frictionally engages the arcuate surface 96' of the first attachment point 48' when weight is applied to the line 20' and the clip 90' is not attached to any attachment point. Where the user removes the weight applied to the line 20', the three-dimensional element 92' simply drops into the reach of the user, so that the user may then attach the clip, as desired, to one of the other attachment points 58', 60'.

It should be appreciated that, in further embodiments, the connection element 50' may be comprised solely of the three dimensional element 92', i.e., without the clip 90'. In such embodiments, the other blocks and grips may also have their own seating surfaces that permit the three dimensional element 92' to seat therein for attachment purposes. One of ordinary skill in the art may select other suitable structures and types of the connection element 50', as desired.

Figure 7:
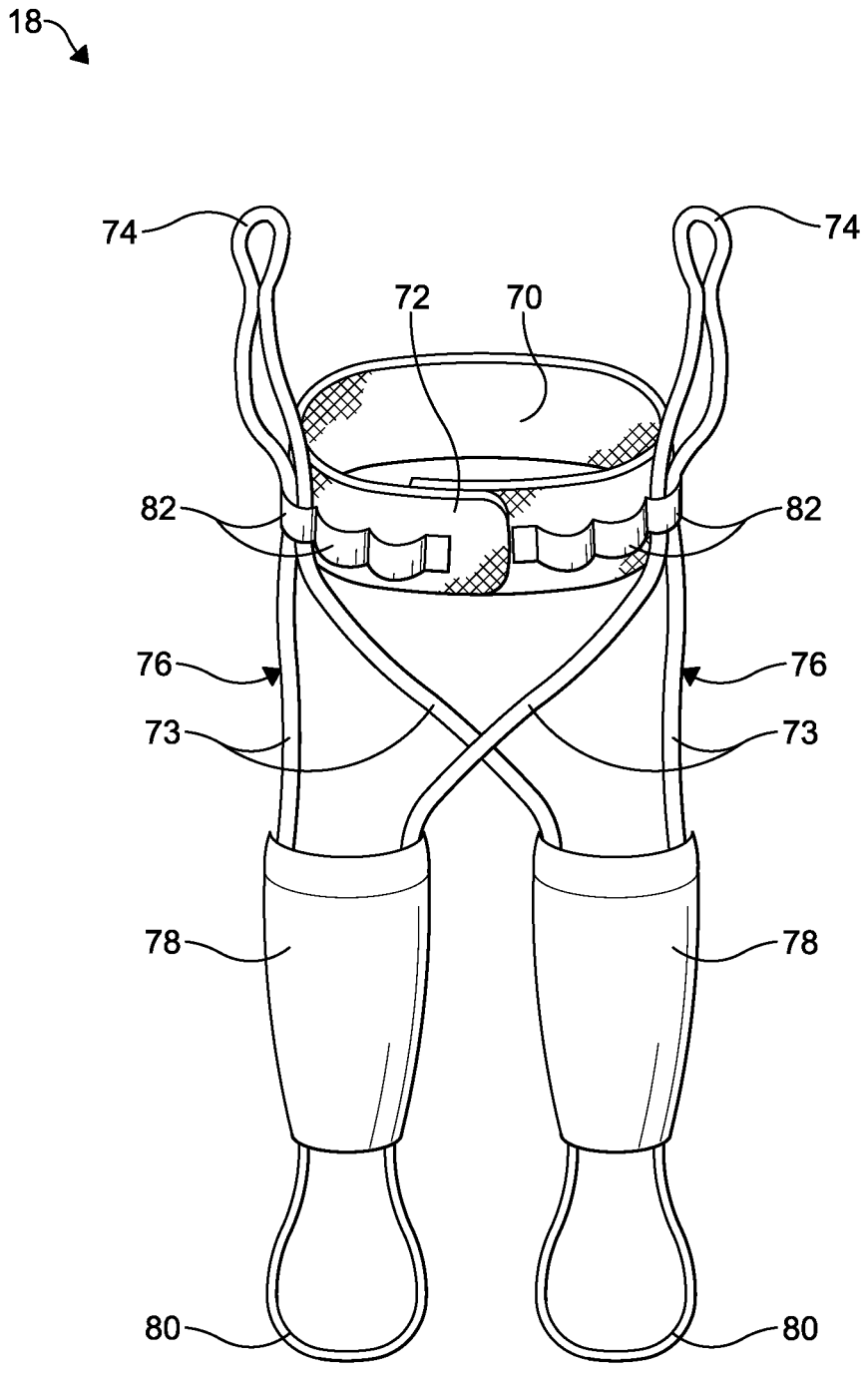
FIG. 7 is a front perspective view of a harness for a body of a user according to one embodiment of the disclosure.

With reference to FIG. 7, the harness 18 according to one embodiment of the present disclosure is shown in further detail. The harness 18 is used to further enhance the adjustability and usability of the system. The harness 18 may include a suspension belt 70 configured to fit around a mid-section of the user. The suspension belt 70 includes a closure strap 72, for example, having a buckle or hook-and-loop fastener. The closure strap 72 may be located on the front of the suspension belt 70 as shown, or may be located at any position along the suspension belt 70 to facilitate entry into and use of the harness 18 by the user. The suspension belt 70 may further include one or more leg straps 73 for securing the harness around upper leg portions of the user.

The harness 18 further includes one or more suspension mounts 74 for removably connecting the harness to one or more of the lines 20, 20'. In one embodiment, the suspension mounts 74 are configured to removably attach with the second block 52 via the second connector 56 on the second block 52. In another embodiment, the suspension mounts 74 are further configured to provide the second attachment point 58 to which the connection element 50 may be removably attached to reduce an effective amount of the weight lifted by the user with movement of the grip 16. In yet another embodiment, the harness 18 includes two suspension mounts 74 disposed on opposite sides of the suspension belt 70 and configured to couple the suspension belt 70 to the second block 52 of the pulley system described herein above.

The harness 18 of FIG. 7 may further be provided with leg stirrups 76 to provide an active weight distribution to the user. The user may thereby exert effort through the leg stirrups 76 to distribute weight attached to the harness 70, and to reduce overall load placed on a pelvic area.

In one embodiment, the leg stirrups 76 are removably connected to the harness 18 via the suspension mounts 74. For example, the leg support straps 73 may form the leg stirrups 76 and terminate in the suspension mounts 74. The leg support straps 73 may also cooperate with the suspension belt 70 via one or more loops 82, for example, as shown in FIG. 7.

In the configuration shown in FIG. 7, the suspension belt 70 does not carry any load attached to the leg stirrups 76 where the user is in an upright orientation (shown also in FIG. 2). It is understood that the one or more loops 82 may be placed on either the inside or the outside of the suspension belt 70. Additionally, it is understood that the one or more loops 82 may be placed anywhere along the belt in order to align the leg support straps 73 consonant with a given exercise. As a non-limiting example, where the user intends to perform exercise in horizontal relation to and facing the floor 34, the leg support straps 73 may be advantageously be placed through one or more loops 82 located on the back portion of the suspension belt 70 adjacent the user's back to avoid the leg support straps 73 from interfering with the user's movements.

As further shown in FIGS. 3 and 7, the leg stirrups 76 further may be configured to provide additional support to a user's knees by including supportive knee straps 78. The knee straps 78 may be advantageously configured to support an entirety of the body of the user upon a bending of the user's knees, thereby minimizing a pressure applied to a back of the user. Alternatively, the knee straps 78 may be configured to provide support in combination with the suspension belt 70. Additionally, the knee straps 78 may be configured to provide support to a portion of a lower leg of the user, including to shins and ankles of the user. Optionally, the knee straps 78 may be removably coupled to the leg support straps 73, providing the user an option to either use or not use the knee straps 78. The knee straps 78 may be further slidably attached to the leg support straps 73 to allow a full range of adjustment of the knee straps 78 along the length of the leg support straps 73, thereby accommodating users of different sizes and leg lengths.

The leg stirrups 76 may further include foot stirrups 80 to provide additional support to a user's feet. The foot stirrups 80 may be configured to support an entirety of the body of the user while the user's knee are unbent, or may be configured to provide support in combination with the suspension belt 70. In use, the leg stirrups 76 may also be removed if a user does not desire support to the user's knees and/or feet. It is understood that the harness 18 of FIG. 7 may be provided with other buckles, fasteners, and material extenders to ensure that the harness 18 is fully adjustable for users of many shapes and sizes.

Figure 8A:
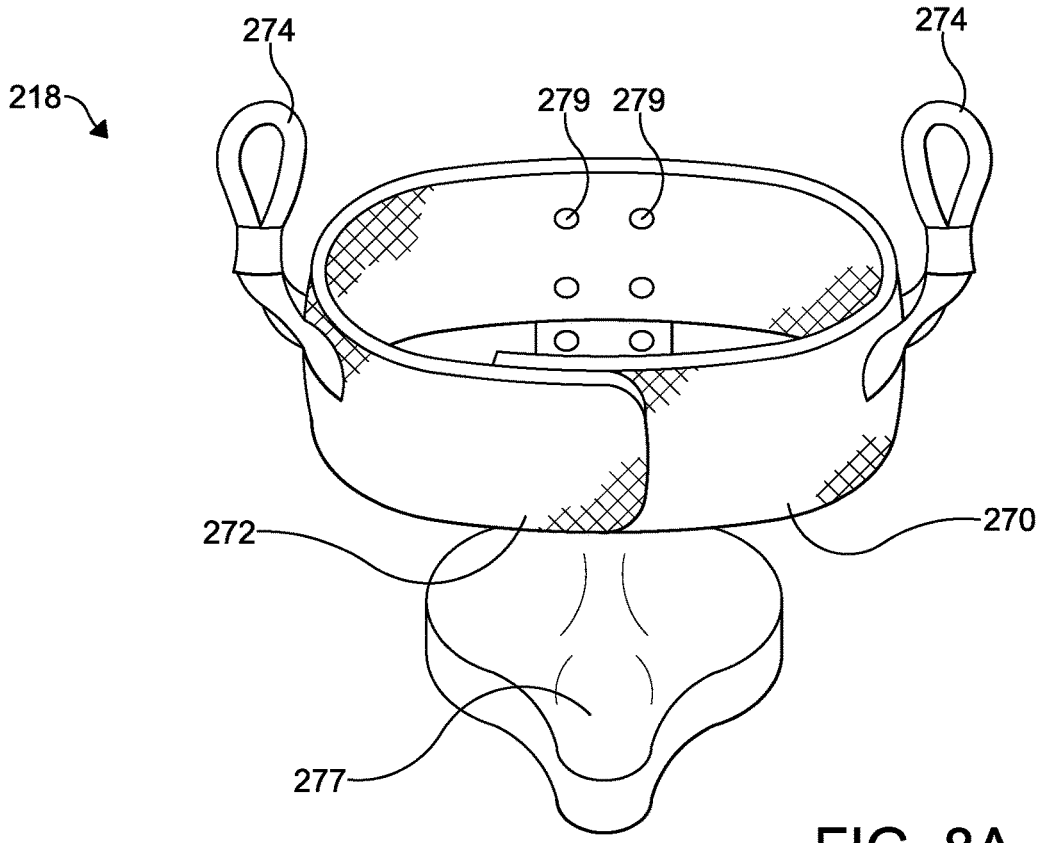
FIGS. 8A and 8B are front perspective and side elevational views, respectively, of a harness for a body of a user according to another embodiment of the invention incorporating a seat for the user.
Figure 8B:
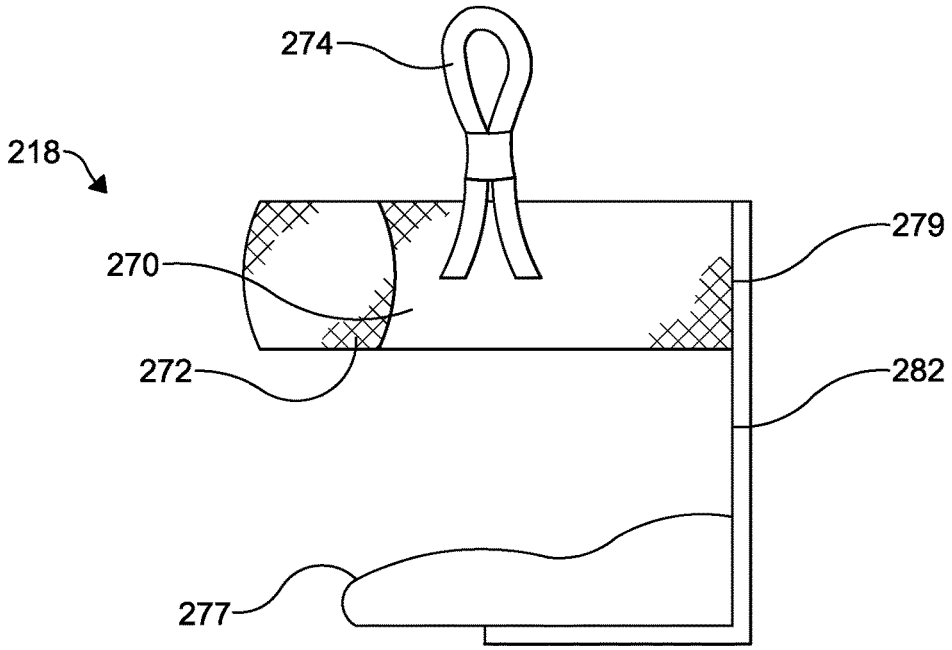

Some users may find it difficult to support a weight using the harness 18, including the leg stirrups 76, shown in FIG. 7. Accordingly, another embodiment of the harness 218 is shown with reference to FIGS. 8A and 8B. In FIGS. 8A and 8B, similar or related structure to that shown in FIGS. 1-7 is identified with the same reference number in a 200-series for purpose of clarity.

The harness 218 may be provided and include the suspension belt 270 configured to fit around a mid-section of a user, and the closure strap 272 configured to secure the suspension belt 270 in place. One or more suspension mounts 274 are provided on the suspension belt 270 for removably connecting the harness 218 to one or more of the lines 20, 20'. In one embodiment, the suspension mounts 274 are configured to removably attach with the second block 52 (FIGS. 5A, 5B, 5C) via the second connector 56 on the second block 152. The suspension mounts 274 may further be configured to provide the second attachment point 58 to which the connection element 50 may be removably attached, in order to reduce an effective amount of the weight lifted by the user with movement of the grip 16.

The harness 218 is additionally provided with a seat 277, which may be fixedly attached to the suspension belt 270 and configured to support the user wearing the harness 218 and to provide a passive weight distribution to the user. The seat 277 may be rigidly or hingedly attached to the suspension belt 270 at a seat support 279. The seat support 279 may be conventionally attached to the suspension belt 270 using known fasteners, such as screws or bolts or the like. The seat support 279 may further include a plurality of holes or connection points disposed along a length of a seat mount 282, permitting the seat mount to be attached to the suspension belt 270 at a variety of locations for accommodating various user sizes.

It should be understood that the exercise device 10 of the present disclosure advantageously provides an extremely high degree of adjustability, and is adaptable to nearly any physical stature, strength, or ability. Since the resistive weight is supported at a point above the floor, a new user may utilize different feet planted positions for maximum load assistance during exercise. The user may further elevate to mid-air positions as the user progresses to intermediate and advanced use, thereby increasing strength and stability levels. Additionally, by utilizing one or more blocks of pulleys in combination with a harness, a user is able to precisely control the weight load being lifted to reduce the resistance felt by the user to some fractional amount of the weight being lifted, which may also be the user's body weight.

Accordingly, using the present invention, a user has full control over body weight load, physical limitations and progression of strength exercised, allowing a user to perform exercise movements and to progress from a beginner to an intermediate and an advanced level, while effectively activating the majority of the major, minor, and stabilizer muscle groups in the upper body. The system provides a varied range of movements, targeting numerous large and small muscle groups, and allow those with less strength to improve their fitness level, flexibility, and endurance in a physiologically safe progression.

Although the harness 18, 218 is described in the present disclosure relative to the exercise device 10, it should be understood that the harness 18, 218 may be used individually in other exercise or sports activities. For example, it is contemplated that the harness 18, 218 may also be used in sporting activities where contact body suspension is used, such as wake boarding as a non-limiting example. These alternative uses of the harness 18, 218 are also considered within the scope of the present disclosure.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. An exercise device for suspended weight training, comprising:

a pulley system having a first block configured to removably connect to a raised position above a floor surface, the first block having a first pulley, a second pulley, and a first attachment point, a second block having a third pulley and a second attachment point, a grip configured to be held by a user while exercising, the grip having a third attachment point, and a line having a first line end fixedly coupled to the grip and a second line end fixedly coupled to a connection element, the connection element configured to be selectively coupled to each of the first attachment point, the second attachment point, and the third attachment point, wherein the line extends from the grip around the first pulley, around the third pulley, and around the second pulley, wherein the first pulley, the second pulley, and the third pulley are arranged so that the line follows a serpentine path; and a harness removably coupled to the second block of the pulley system, wherein the harness has a user-adjustable suspension belt for securing around a waist of a body of the user, and a set of support straps for distributing weight to a lower extremity of the user, wherein the support straps include both knee support straps and foot support stirrups, wherein the selective coupling of the connection element to each of the first attachment point, the second attachment point, and the third attachment point permits the user to reduce an effective amount of the weight lifted by the user with movement of the grip to a pre-selected fraction of the weight, and wherein the weight includes a body of the user in the harness.

2. The exercise device of claim 1, wherein the connection element includes at least one of a clip and a three-dimensional element.

3. The exercise device of claim 1, wherein the second pulley of the pulley system is disposed on the first block between the first pulley and the first attachment point, the second attachment point of the second block is disposed between the first attachment point of the first block and the third pulley of the second block, the second block has a connector for removably coupling the harness to the second block, and the connector is disposed between the third pulley of the second block and the floor surface.

4. The exercise device of claim 3, wherein the connector includes a swivel loop.

5. The exercise device of claim 1, wherein the suspension belt of the harness has a closure strap configured to secure the suspension belt in place around the waist of the body of the user, the support straps engaging the suspension belt through at least one loop on the suspension belt, the support straps directly attached to the pulley system of the exercise device, wherein the foot support stirrups and the knee support straps are connected to the suspension belt with leg stirrups, and wherein the foot support stirrups are configured to support an entirety of the body of the user while the user's knee are unbent, and the knee support straps are configured to support the entirety of the body of the user upon a bending of the user's knees.

6. The exercise device of claim 1, wherein the grip has a channel formed in an outer perimeter of the grip that is configured to receive and store an excess amount of the line.

7. The exercise device of claim 1, further comprising at least one suspension mount configured to couple the suspension belt to the pulley system of the exercise device.

* * * * *